US010267533B2

(12) United States Patent
Mantyla et al.

(10) Patent No.: US 10,267,533 B2
(45) Date of Patent: Apr. 23, 2019

(54) GOOSENECK STYLE VENT

(71) Applicant: CANPLAS INDUSTRIES LTD., Barrie (CA)

(72) Inventors: James Mantyla, Barrie (CA); Scott Baldwin, Midhurst (CA)

(73) Assignee: Canplas Industries Ltd., Barrie, Ontario (CA)

( * ) Notice: Subject to any disclaimer, the term of this patent is extended or adjusted under 35 U.S.C. 154(b) by 181 days.

(21) Appl. No.: 14/932,068

(22) Filed: Nov. 4, 2015

(65) Prior Publication Data

US 2016/0131392 A1 May 12, 2016

(30) Foreign Application Priority Data

Nov. 12, 2014 (CA) ..... 2870440

(51) Int. Cl.

| | |
|---|---|
| ***F24F 13/20*** | (2006.01) |
| ***F24F 7/02*** | (2006.01) |
| ***F24F 13/14*** | (2006.01) |
| ***F24F 13/08*** | (2006.01) |

(52) U.S. Cl.

CPC ..... *F24F 13/20* (2013.01); *F24F 7/02* (2013.01); *F24F 13/082* (2013.01); *F24F 13/14* (2013.01)

(58) Field of Classification Search

CPC .... F24F 7/02; F24F 13/14; F24F 13/20; F24F 13/082

USPC ..... 454/353

See application file for complete search history.

(56) References Cited

U.S. PATENT DOCUMENTS

| | | | | |
|---|---|---|---|---|
| 2,741,972 | A * | 4/1956 | Pryne | F23L 17/02 454/27 |
| 4,625,630 | A | 12/1986 | Carroll et al. | |
| 5,046,408 | A | 9/1991 | Eugenio | |
| 5,344,363 | A | 9/1994 | Pollock | |
| 5,591,080 | A | 1/1997 | Ward | |
| 5,662,522 | A | 9/1997 | Waltz | |
| 5,916,023 | A | 6/1999 | Meyer | |
| 6,149,516 | A * | 11/2000 | Mantyla | F24F 7/007 454/349 |
| 6,302,788 | B1 | 10/2001 | Gagnon | |
| 6,994,622 | B2 | 2/2006 | Koessler | |
| 8,033,900 | B2 | 10/2011 | Vanden Bosch et al. | |
| 8,205,401 | B2 | 6/2012 | Ward | |
| 9,080,779 | B1 * | 7/2015 | Leonard | F24F 11/0001 |

(Continued)

FOREIGN PATENT DOCUMENTS

CA 2511411 A1 1/2007

*Primary Examiner* — Steven B McAllister
*Assistant Examiner* — Allen Schult
(74) *Attorney, Agent, or Firm* — Hoffmann & Baron, LLP

(57) ABSTRACT

A goose neck style vent has a base that registers with a surface opening of a building, and upstanding walls which form a portion of a curved air flow pathway above the vent opening. A top portion of the vent registers with the base to complete the curved air flow pathway and define an air outlet opening. The top includes a screen that hinges to cover the air outlet opening. A flapper valve is positioned across the curved air flow pathway and is hinged to the base at one end. The opposite free end of the flapper valve is urged to a closed position by gravity and to an open position by air pressure from below. An upstanding air deflecting baffle extends above the free end of the flapper, and limits air gusts passing through the screen and under the free end of the flapper valve.

25 Claims, 8 Drawing Sheets

(56) References Cited

U.S. PATENT DOCUMENTS

| | | | | |
|---|---|---|---|---|
| 2005/0003755 | A1* | 1/2005 | Koessler | F24F 13/08<br>454/359 |
| 2006/0025067 | A1* | 2/2006 | Koessler | F24F 7/02<br>454/359 |
| 2007/0010190 | A1 | 1/2007 | Butler | |
| 2011/0061751 | A1* | 3/2011 | Jumpol | F16K 15/03<br>137/527 |

* cited by examiner

GOOSENECK STYLE VENT

FIELD OF THE INVENTION

This invention relates generally to the field of ventilation products and more particularly to exterior vents of the type that are used to vent the inside of buildings. Most particularly this invention relates to exterior vents which may be used to vent air from bathrooms, kitchens, dryers and the like or to allow air into the building in certain circumstances.

BACKGROUND OF THE INVENTION

Modern buildings are being made ever more energy efficient which often translates into better insulation and less air infiltration through cracks, gaps or the like. As a consequence, the airflow into and out of the building envelope must be very carefully managed.

Another consequence of a tighter building envelope however is the need to manage the exhaust air flow which may be required from other building systems. Three systems in particular have localized blowers to force vent air in certain circumstances, and they include bathroom exhaust fans, to vent moisture laden air from bathrooms, kitchen exhaust fans to vent the by products of cooking which may include steam, greasy vapours and smoke, and electric dryer exhausts, which again are for the purpose of venting moist air from the drying of laundry inside a dwelling or building envelope.

Particular to these types of exhaust air is the back pressure created by the local appliance, such as the bathroom exhaust fan, the kitchen exhaust fan and the electric dryer exhaust blower. Also particular to these types of exhausts is the need to let the exhaust air out when there is a need to, but to prevent air from leaking out, or more precisely to prevent outside air from leaking in or infiltrating into the building envelope, when the appliance is not in use. Concomitant with this there is a need to make the air flow passageway impervious to pests, animals, rodents and the like, that might otherwise try to gain entry into the building.

As a result, there is a need for vents which permit the air to be vented outside of the building, but which prevent unwanted air from infiltrating back into the building and which are protected from pests. Typically a flapper valve is used for this purpose which can open when the air is being exhausted and which closes when there is no air flow. A secondary need is to provide a screen or other structure which can be used to prevent animals or pests from getting into the building through the vent opening.

Various designs have been proposed in the past including vents made from metal, but these tend to be expensive and easily damaged in transit. Further a metal flapper valve can make quite a bit of noise when it opens and closes. A problem with prior art designs is that wind or weather can change the air pressure around the exterior of the vent causing the flapper to flap up and down even when the inside appliance is not turned on and there is no need for the vent to be open. This constant chatter can become a serious issue to an occupant.

SUMMARY OF THE INVENTION

What is desired is a simple to use, inexpensive, easy to install, and aesthetically pleasing vent that will allow air to escape when it is desired and yet will protect the vent from unwanted opening and closing of the flapper valve. Such a design would preferably be quiet and reliable and should also prevent unwanted pests and the like from intruding into the building through the vent. Such a vent would preferably respond to the need to vent air, but would otherwise be reliably closed to prevent the infiltration of weather and outside air.

The present invention provides in a preferred embodiment a form of an inexpensive and yet durable vent. The vent may be formed from a flexible material such as sheet metal or molded plastic, such as polypropylene, which is durable and not easily damaged. Such a plastic vent will preferably have a flapper valve that opens and closes silently as compared to the prior art metal devices. The vent may include a built-in screen to limit weather and pests from impinging on the flapper valve or getting into the building through the vent. Most preferably the vent can be comprised of a number of separate elements that are easily molded and which can be easily assembled to form a complete vent structure having certain desirable features as explained below.

Therefore, according to a first aspect the present invention provides an exterior vent for venting an interior space through a sloped surface opening in a building envelope, the exterior vent comprising:

a base having a vent opening for registering with the surface opening in the building envelope and an attachment flange surrounding said vent opening for securing said vent to an outer surface of said building envelope around said surface opening; said base further having upstanding side and end walls to define said vent opening and to form a portion of a curved air flow pathway above said vent opening, a screen, a top which registers with said base to complete said curved air flow pathway and to define an air outlet opening which is facing generally in a different direction from said vent opening, said top including a screen secured to said top by means of a hinge, said top including attachment means to secure said top portion to said base and to trap said screen between said base and said top portion whereby said air outlet opening is covered by said screen, and a flapper valve positioned across said curved air flow pathway, said flapper valve being hinged to said base and having a free end; said flapper valve being urged to a closed position by gravity and to an open position by air pressure from below, said vent including a rest for said free end of said baffle, said rest having an upstanding weather deflecting baffle extending above said free end to limit air gusts from passing through said screen and under said free end of said flapper valve.

In an alternate embodiment the present invention can be used as an air intake vent, with the flapper valve removed. The vent can also be used on a sloped roof surface. Another aspect of the invention includes an adaptor collar to interface with at least two and preferably three different duct sizes.

BRIEF DESCRIPTION OF THE DRAWINGS

Reference will now be made by way of example only to preferred embodiments of the invention by reference to the following drawings in which.

DETAILED DESCRIPTION OF THE PREFERRED EMBODIMENTS

Figure 1:
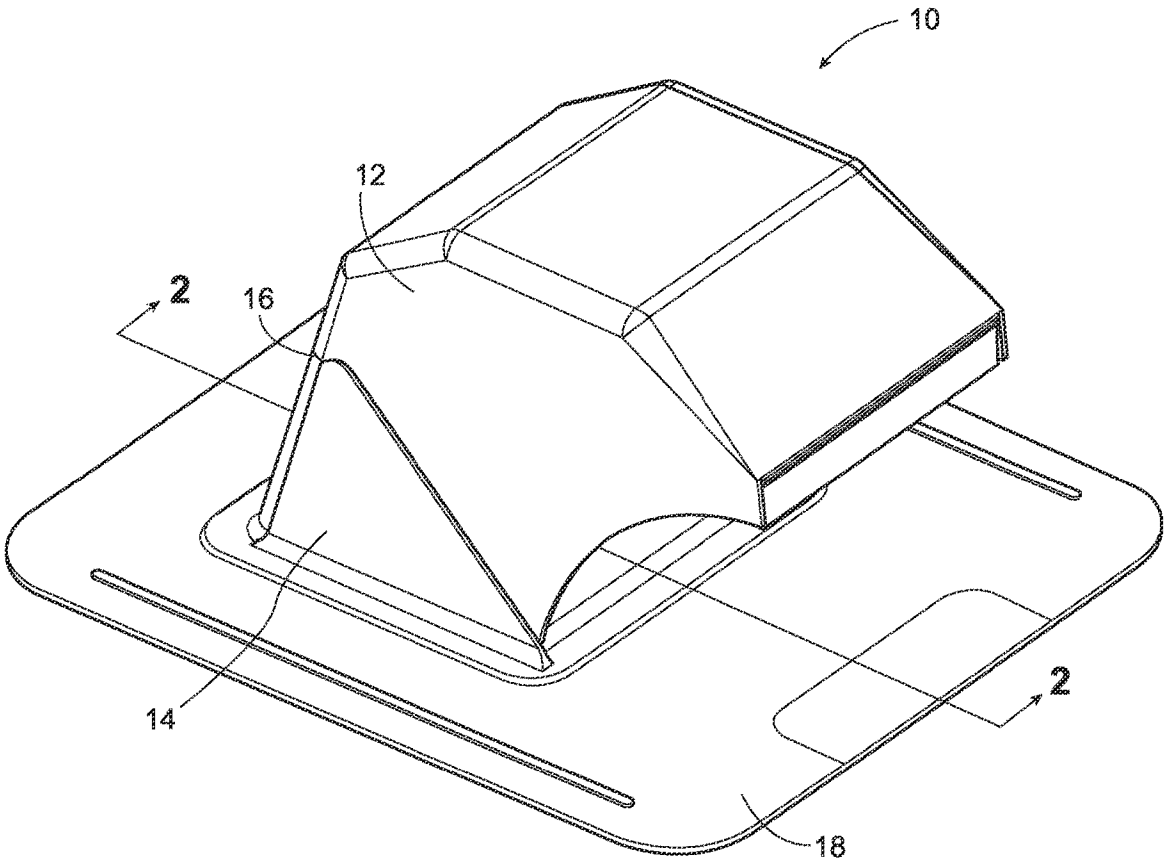
FIG. 1 is a perspective view of an exterior vent according to the present invention.
Figure 2:
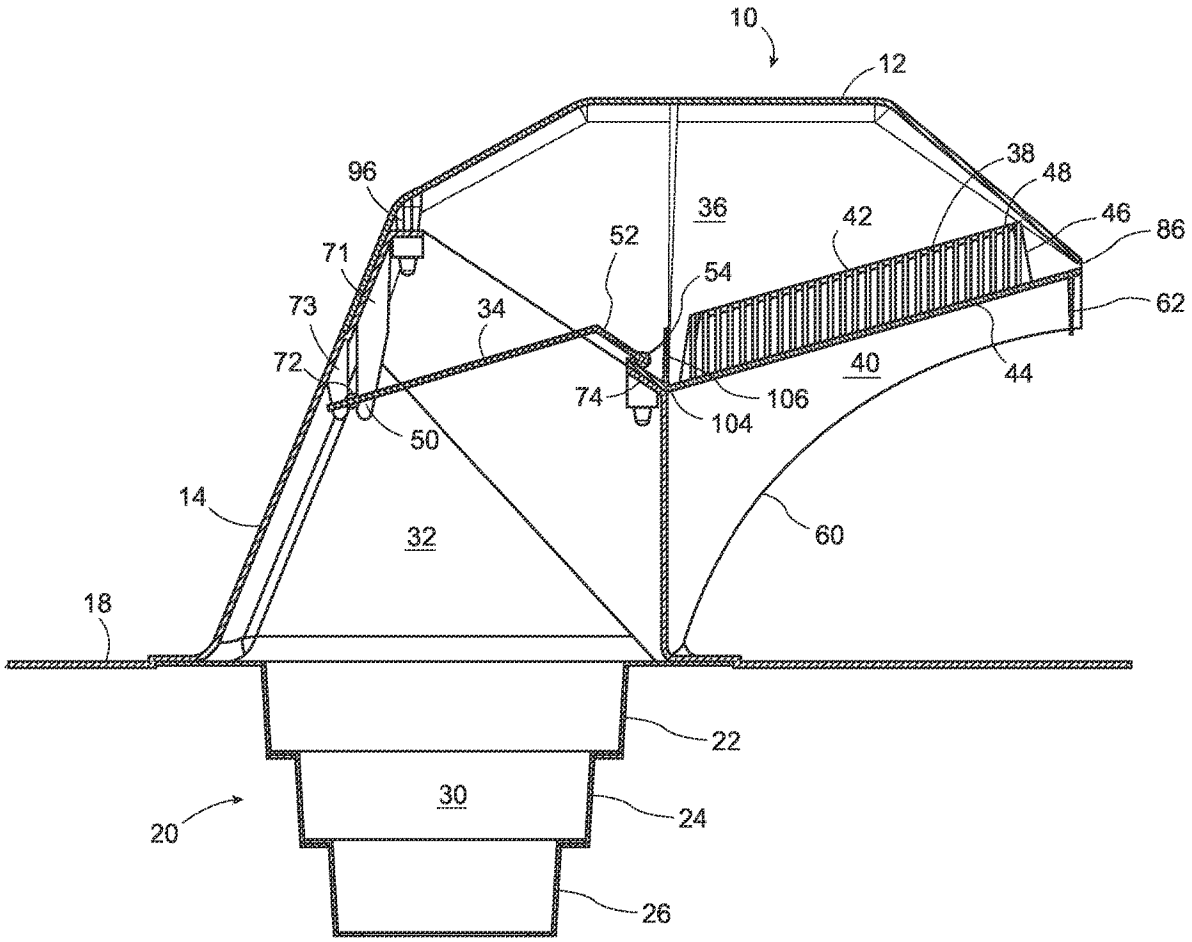
FIG. 2 is a cross sectional view along lines 2-2 of FIG. 1.

A gooseneck style vent, according to a preferred embodiment of the invention, is shown as 10 in FIG. 1. It includes a top 12 and a base 14. A join line 16 exists between the base 14 and the top 12. The base also includes a nailing flange 18 and a duct connector 20 (FIG. 2) extending from said base 14 on an opposite side to said top FIG. 2 is a cross-sectional view through the duct connector 20, the base 14 and the top 12. As can be seen, the duct connector 20 includes at least two and in a preferred embodiment three different sized connectors for connecting to different sized ducts. These are shown as 22, 24 and 26 respectively. Most preferably, an installer would determine the duct size being connected to the duct and would remove with a knife or other sharp edge any connector sections which were too small. In this way a single connector can be made adaptable to at least two and preferably three standard duct sizes.

The vent 10 of the present invention defines an air passageway having discreet sections. The first section 30 is the inside of the duct connector 20. The next section 32 is inside of base 14 above the nailing flange 18, but below a flapper valve shown as 34. The next section 36 is between the flapper valve 34 and a screen 38 inside of top 12. The next section is the flow through the screen 38. The last portion is below the screen 38 and may be called an air flow outlet 40 described in more detail below. Each section of the airflow passageway through the vent is separately described below.

The first section 30 of the air flow passageway is the duct connector portion 20. As noted above, the present invention is intended to be easily field fastened to a duct leading from an air exhausting source (not shown). The source can be any conventional type of blower such as a bathroom fan, a kitchen fan, a dryer blower or the like. In most cases the blower will be designed to work with a standard sized round duct, which is piped from the blower location to the location where the vent is to be installed. This may be, for example, on a sloped roof surface of a building. The three different diameters presented by the duct connector 20 permit the installer to connect the duct to the vent in an air tight manner with a minimum of effort. All that is needed is to remove the duct diameter connectors which are too small. The connector 20 may be made from an easy to cut material, such as plastic, to facilitate the removal of the unwanted connector sections. While the cut can be made in a number of places it is preferred to cut through the horizontal platforms or steps between each duct section for each of access. As described in more detail below, a thin cut line or guide can be provided to assist in the trim step.

The next section 32 of the airflow passageway is located in the base 14 of the vent 10 underneath the flapper valve 34. In general the flapper valve 34 is hinged at one end 50 and has free end 52 which sits on a seat 54. Gravity closes the flapper valve and urges the free end 52 onto the seat 54. Air pressure below the flapper valve, created for example by an air exhausting source, will lift the flapper valve off the seat allowing the air to escape.

The escaped air is now in the next section 36 between the flapper valve 34 and the screen 38. The air can pass through the three dimensional screen 38 and then is found in the air outlet section 40. This section 40 is defined by weather protecting side baffles 60 and an overhanging weather baffle 62. These baffles help protect the screen 38 from inclement weather by restricting the ability of precipitation to impinge directly upon the screen 38. It will be noted that the screen 38 is generally facing in a different direction in the air flow passageway from the duct connector 20. In addition the screen 38 is designed to have generally rectangular corrugations 42 having outwardly facing surfaces 44 and secondary surfaces 46 perpendicular to the outwardly facing surfaces. In a preferred embodiment the outwardly facing surfaces can be made solid and the perpendicular surfaces can be made with grills 48 so that the air can flow out but weather, such as precipitation, which impinges on the screen from directly below is blocked. This style of screen may be called a three dimensional screen.

Figure 3:
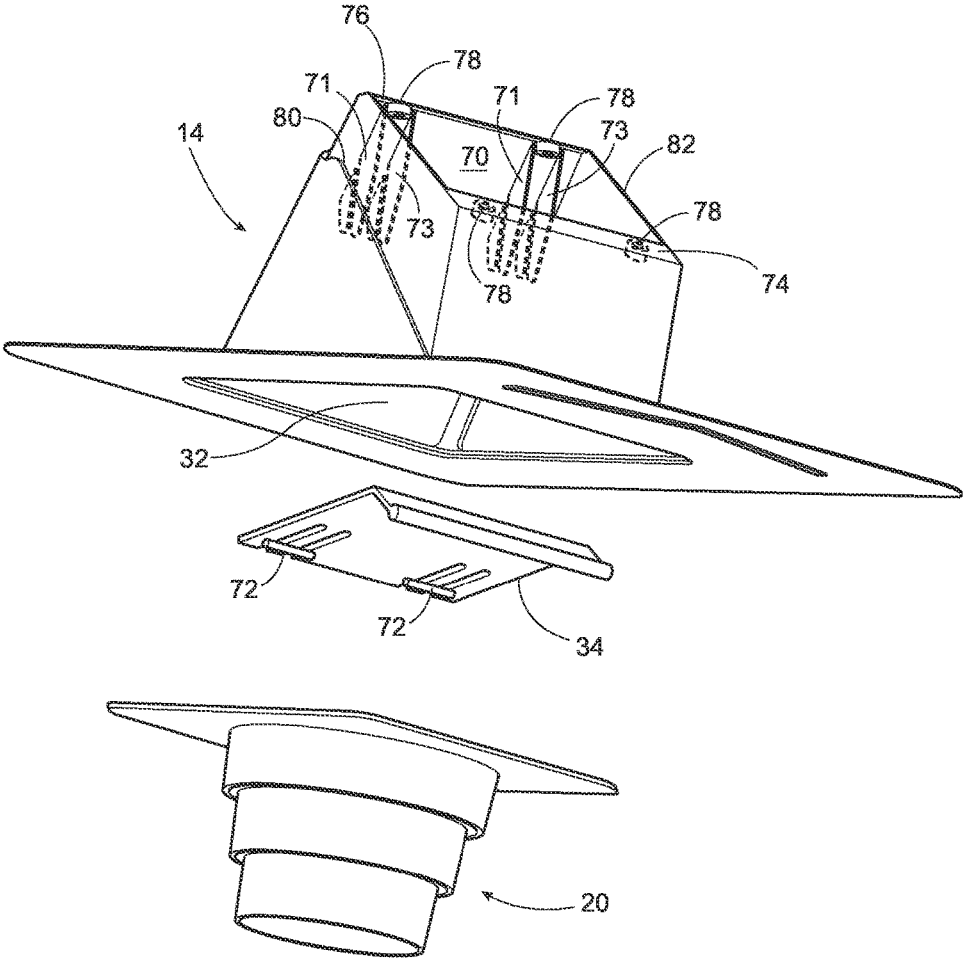
FIG. 3 is an exploded view of the adaptor collar, the flapper valve and the base portion of the vent of FIGS. 1 and 2 with the top removed.

FIG. 3 shows the base 14 separated from the other parts. The base 14 includes an angled throat section 70 which defines the second air flow passageway 32 below the flapper valve 34. It can now be understood that the flapper valve 34 is easily snapped into place by means of opposed hinge pins 72 best seen in FIGS. 2 and 8) built into flapper 34. Opposed support flanges 71 and 73 are molded in to the base to provide a female snap feature for pivotally retaining each of the hinge pins 72. Also shown are upwardly directed faces 74 and 76 which include attachment openings 78. Four such openings 78 are shown, although more or fewer can also be used. The attachment openings 78 are to secure male attachment members 94 located in the top 12 as described below.

Also shown is a ledge 80, which goes up one side and then across the back and then down the other side. The base 14 has an angled top edge 82 and the ledge 80 may be generally parallel to or angled relative to the top edge 82 as it goes around the base 14. The function of the ledge 80 is described in more detail below.

Figure 4:
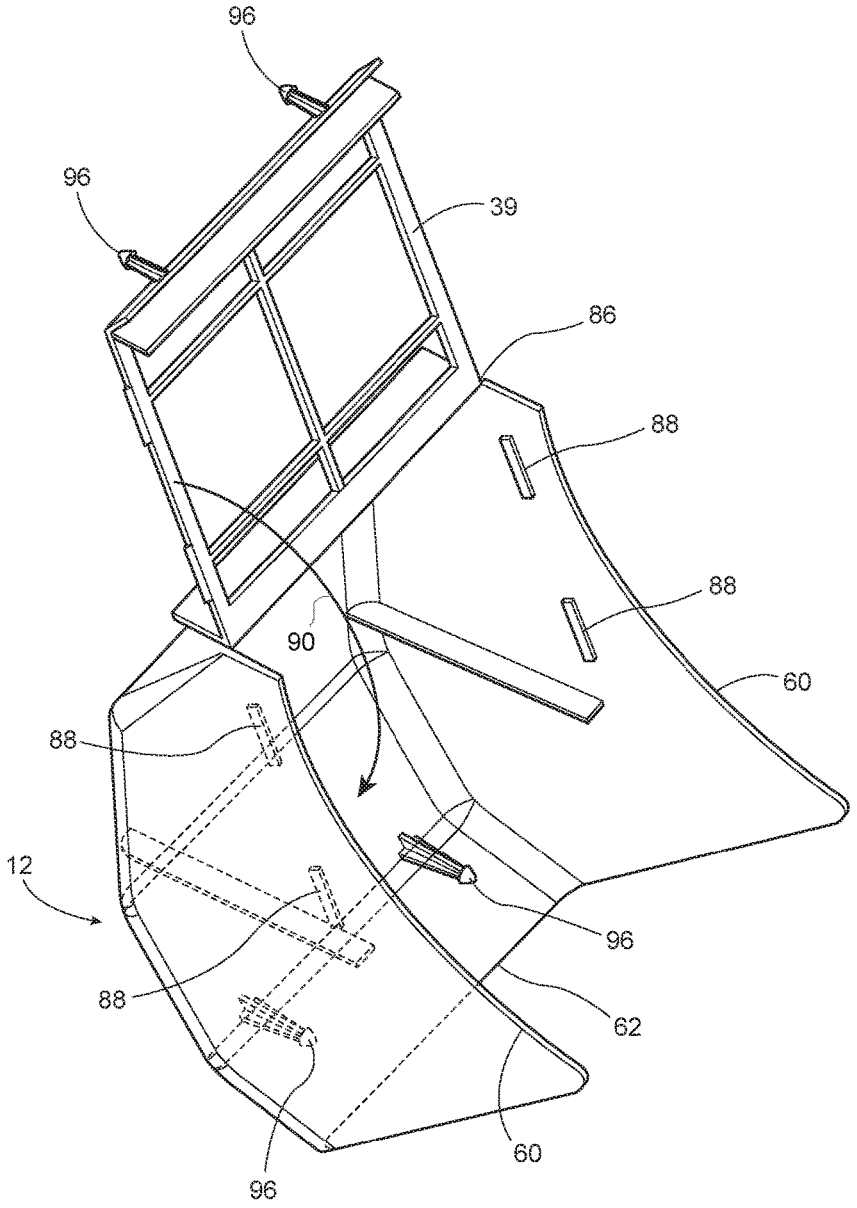
FIG. 4 is a perspective view of a top portion of the vent of FIG. 1.

FIG. 4 shows the top 12 with the preferred curved side baffles 60 and the overhanging baffle 62, all of which may be used to shelter the screen 39 from inclement weather. The screen 39 is a second embodiment of the screen which may be preferred to use on a dryer vent. In this case, the screen is very open so that lint does not collect which could otherwise block the grill if the openings were smaller as shown in the first embodiment of FIG. 1. As shown the screen 39 is an outward position but is hinged to the top 12 along line 86. Recesses 88 are formed so that when the screen 39 is hinged under, tabs on the screen register with the recesses 88 and can be secured therein. The recesses 88 are positioned so that the male members 94 register with attachment openings 78 in the base 14 when the recesses 88 are engaged. By means of the hinge line 86 which is the connection between the screen and the top the two parts can be molded together and then when it is time to assemble the top to the base, the hinge can be used to fold the screen under the front edge of the top in direction of arrow 90 until is covers the air outlet opening as shown in FIG. 4. Alternatively the screen could be a separate part, sandwiched between the top and the bottom.

Figure 5:
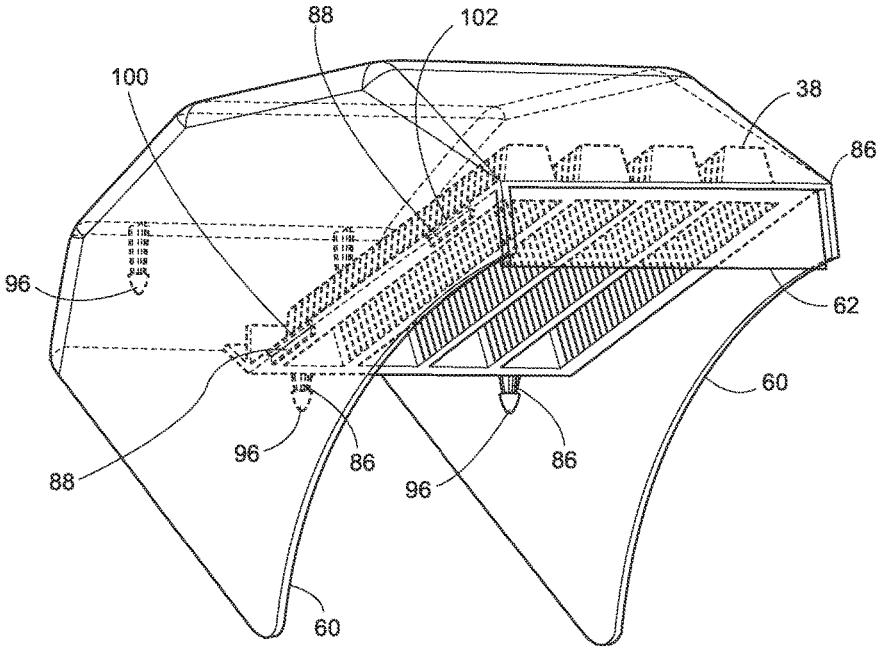
FIG. 5 is a perspective view the top portion of the vent with the first screen embodiment.

FIG. 5 shows an underside view of the screen 38 in the folded over position. Male attachment members 86 which are positioned to mate with the four attachment openings 78 formed in the base 14. By means of the arrow headed ends 96 on the attachment members 94 they can be force fit through the openings and then locked in place against the underside of the ledge to secure the top 12 to the base 14. While this provides good results it will be understood by those skilled in the art that various other locking configurations can be used without departing from the scope of the invention. Also, as shown in FIG. 5, are tabs 100 and 102 molded on the side edges of the screen 38 which snap into recesses 88 molded into top 12. In the assembled configuration as shown in FIG. 2, the screen has been folded over and one edge 104 rests in the upwardly directed face 74. Thus when the screen is trapped between the top 12 and the base 14, one edge rests on the face 74 and the tabs 100 and 102 extending from the sides of the screen 38 engage with the recesses 88 in top 12 to support the sides of the screen so it is firmly held in place.

It can now be appreciated that two transverse weather baffles can be formed in association with the screen. One, close to the hinge, rotates downwardly as the screen is rotated under and ends up becoming the overhanging baffle 62. A second which extends in an opposite direction and is located towards a free end of said screen is rotated into place as an internal weather deflecting baffle 106 (best seen in FIG. 2). Once the screen is locked in place between the top and the base, the baffle 106 is positioned above the valve seat of the flapper valve to protect the flapper valve from inclement weather or gusts of wind that might pass through the screen. Such an internal weather deflecting baffle helps to prevent the flapper valve from being constantly displaced by stray air currents. In this way the clattering noise associated with some of the prior art designs, which noise is caused by the constant banging of the flapper valve up and down, may be mitigated.

Figure 6:
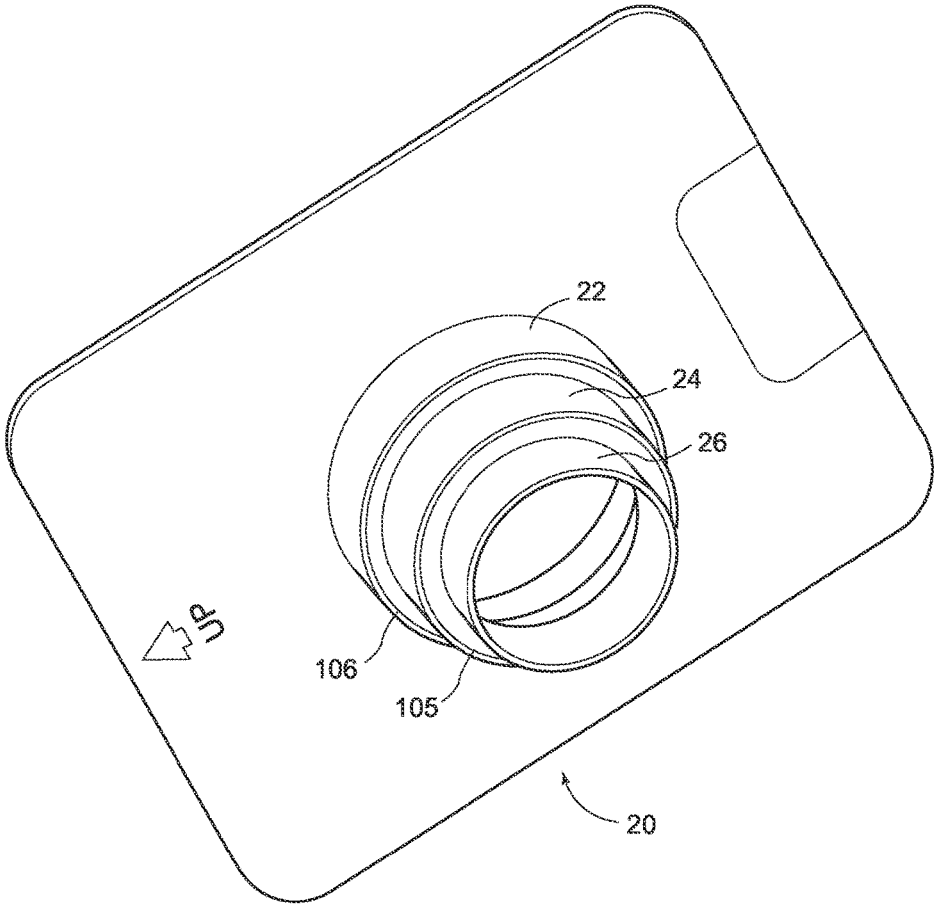
FIG. 6 is a view of a duct collar of the present invention.

FIG. 6 shows the duct connector 20 which may be used as part of the present invention. As can be seen, in this form it is a separate element that can be installed beneath the nailing flange 18 of the base 14 and which extends backwardly through the opening in the building envelope to connect with a duct carrying the air to be exhausted. It can be secured to the base 14 by gluing or the like, or it can be simply fit onto the duct as appropriate and then the base 14 can be nailed in place over top of the duct connector with nails or other fasteners that at the same time fasten the duct connector in place. The duct connection can be provided with cut guides 106, 105 as shown between the steps 26, 29 and 22.

Figure 7:
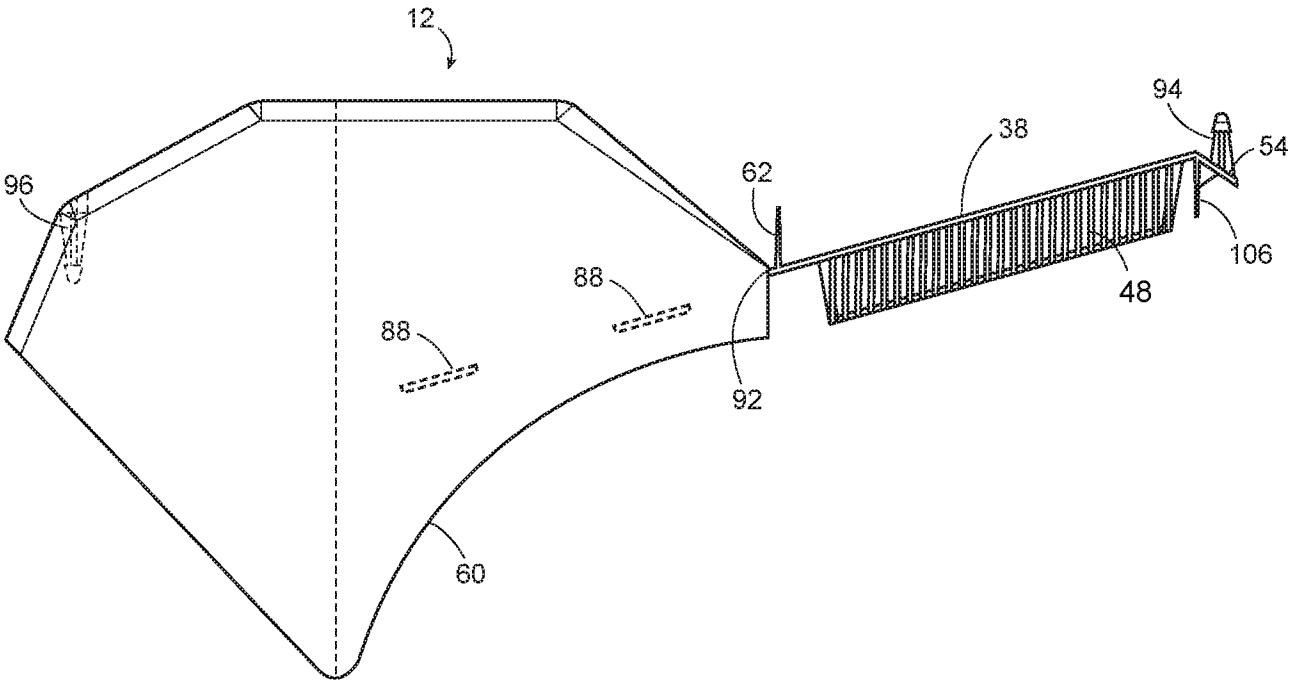
FIG. 7 is a sectional view of the top and grill sections FIG. 1 having a first screen embodiment.
Figure 8:
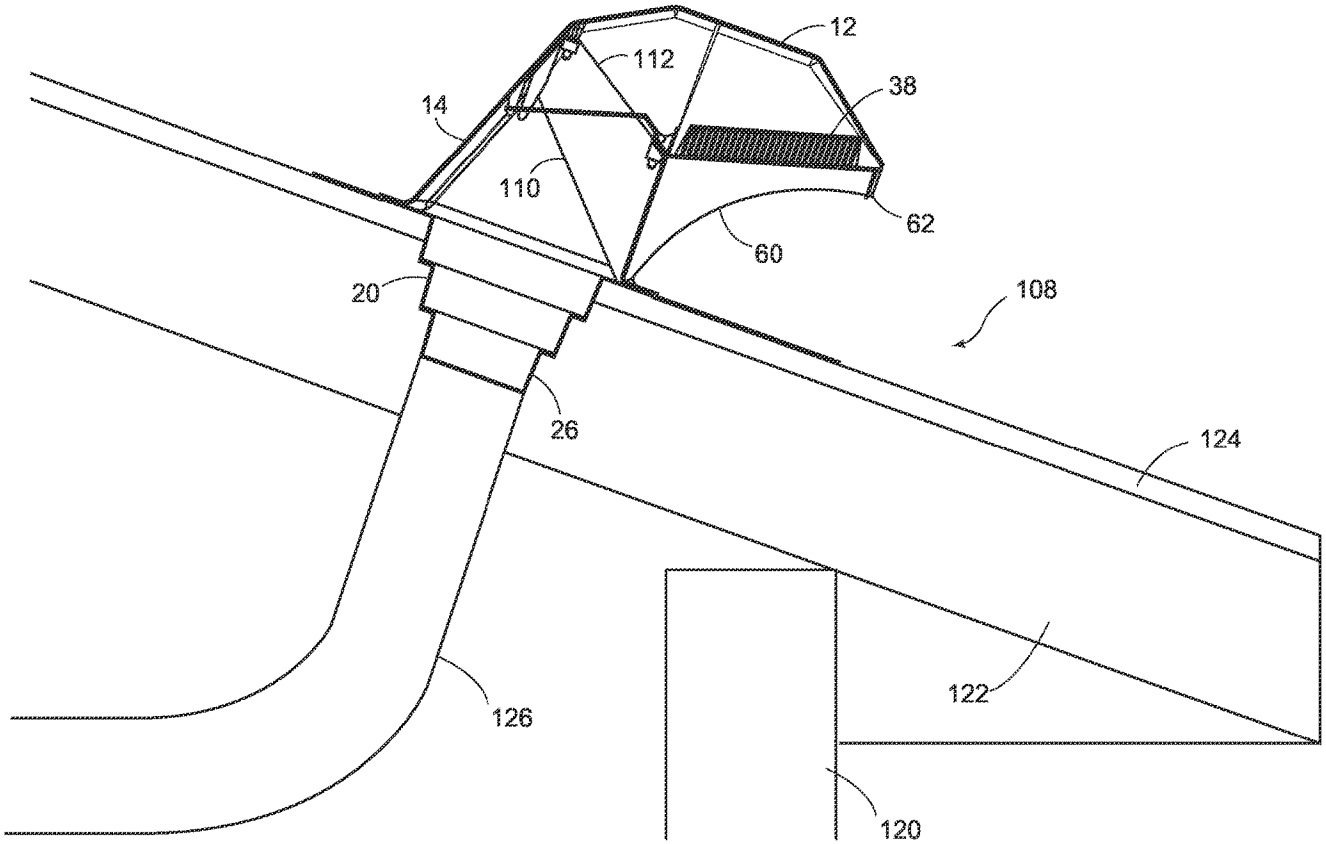
FIG. 8 is a cross-sectional view of the components together as installed on a sloped roof surface.

FIG. 7 shows the screen 38 and top portion 12 as molded. In this configuration, the screen 38 is in an extended position, which best demonstrates the relationship of the two weather baffles to the screen 38. As noted above, overhanging baffle 62 is located at the end closest to the hinge 92, and will extend downwardly as the screen is rotated into its folded over position. At the opposing end of screen 38 is an extension that is angled such that, when the screen is rotated into its folded position, it rests flat against upwardly directed face 74 on the base 14 (see FIG. 2) and will become seat 54 on which flapper valve 34 rests in its closed position. The internal weather deflecting baffle 106 also extends from the opposing end of screen 38, from a point adjacent to but inwardly from seat 54. Preferably, the baffle 106 and seat 54 extend from substantially the same point on screen 38, as shown in FIG. 8, and form a substantially V-shaped structure. Thus, when the screen is rotated into its folded over position, the internal baffle 106 will extend upwardly above the free end of flapper valve 34, and limit the influence of infiltrating air gusts to pass under the free end of the flapper valve.

FIG. 8 shows the wall 120 of the house supporting rafters 122 and a roof deck 124. The duct 126 is attached to the adaptor 20 as shown, in this case on the step 26. Shingles would also be installed in a known manner on the roof deck as will be understood by those skilled in the art. The adapter collar 20 can also be installed under the roof sheeting 124.

FIG. 8 also shows all of the components together in an installed position on a roof 108. As can be seen there is a line 110 that extends up from the nailing flange on a diagonal and a second line 112 that is above the first line 110. The base 14 is a male part and the top 12 is a female part that fits over and onto the male part. The bottom edge of the top fits over the side walls of the base and at the point that the attachment members of the top are secured within the attachment openings of the base, the lower edge of the sides of the top 12 rest on a ledge along line 110 formed on the base 14. The base can extend up a fair ways from the ledge 110, inside of the ledge, so that there is a large amount of internal overlap between the base 14 and the top 12. This provides for structural stiffness as well as forming a connection between the base and the top that will prevent water from flowing through the joint. Quite simply the inner base wall overlap is too large for any water to find its way through the overlap, even if it could get into it in the first place.

In another embodiment the invention may be used as an intake vent, in which case there would be no collar nor any flapper valve as part of the vent. As well, in some cases a form of dryer vent may be used, as noted above with a lint compatible or lint passing grill. The foregoing description describes various embodiments of the invention but the scope of the invention is limited only by the appended claims. Various modifications and alterations to the invention are possible without departing from the scope of the claims attached. Some of these have been discussed above and other will be apparent to those skilled in the art.

We claim:

1. An exterior vent for venting an interior space through a sloped surface opening in a building envelope, the exterior vent comprising:

a base having a vent opening for registering with the surface opening in the building envelope and an attachment flange surrounding said vent opening for securing said vent to an outer surface of said building envelope around said surface opening, said base further having upstanding side and end walls around said vent opening to form a portion of a curved air flow pathway above said vent opening;

a top having an air outlet opening, said top being configured to register with said base to complete said curved air flow pathway above said vent opening to said air outlet opening;

a screen covering said air outlet opening, said screen having one end attached to said top by a living hinge, and a free end hinged into a position between said top and said base, said free end of said screen including a flapper rest and a weather deflecting baffle;

attachment means for attaching said top to said base with said flapper rest positioned at a top edge of said upstanding end wall of said base adjacent to said air outlet opening; and a flapper valve for closing and opening said curved air flow pathway, said flapper valve having one end hingedly attached to one of said upstanding side and end walls, and a free end movable between a closed position defined by said flapper rest and an open position, said flapper valve being urged to said closed position by gravity and to said open position by air pressure from below;

wherein said weather deflecting baffle is positioned between said free end of said flapper valve and said air outlet opening, and extends upwardly from said flapper rest into said curved air flow pathway to limit air gusts passing through said screen from passing under said free end of said flapper valve.

2. The exterior vent of claim 1 wherein said screen is integrally molded with said top.

3. The exterior vent of claim 1, wherein said upstanding side and end walls define a continuous top edge lying in a plane which is at an angle to said attachment flange;

wherein said top has walls defining a bottom edge;

wherein said side and end walls of said base define a first overlapping portion ending in an outwardly directed shoulder below said continuous top edge, and said walls of said top define a second overlapping portion ending in an inwardly directed shoulder above said bottom edge; and wherein when said top is attached to said base, said first and second overlapping portions form an overlapping joint which prevents water from entering the vent through said overlapping joint.

4. The exterior vent of claim 3, wherein said outwardly directed shoulder is substantially parallel to said plane.

5. The exterior vent of claim 4, wherein said outwardly directed shoulder is continuous around at least three of said side and end walls of said base.

6. The exterior vent of claim 3, wherein said inwardly directed shoulder and said bottom edge of said top are substantially parallel.

7. The exterior vent of claim 3, wherein at least a portion of said inwardly directed shoulder of said top is sized, shaped and positioned to rest on at least a portion of said continuous top edge of said base, when said top is attached to said base.

8. The exterior vent of claim 3, wherein at least a portion of said bottom edge of said top is sized, shaped and positioned to rest on at least a portion of said outwardly directed shoulder of said base, when said top is attached to said base.

9. The exterior vent of claim 1, wherein said weather deflecting baffle extends across said curved air flow pathway between said upstanding side walls of said base.

10. The exterior vent of claim 9, wherein said weather deflecting baffle is substantially vertical and positioned beyond an arc defined by said free end of said flapper valve as said flapper valve hinges between said open and closed positions.

11. The exterior vent of claim 10, wherein said free end of said flapper valve is bull nose shaped to further limit the ability of outside weather to get underneath said flapper valve when said flapper valve is in said closed position.

12. The exterior vent of claim 11, wherein said bull nose shaped free end adds weight to bias said flapper valve to said closed position.

13. The exterior vent of claim 1, wherein said attachment means comprises inter-engaging attachment members.

14. The exterior vent of claim 13, wherein said inter-engaging attachment members comprise a) arrow headed attachment members on one of said top and said base, and b) receptacles adapted to receive said arrow headed attachment members, on the other of said top and said base.

15. The exterior vent of claim 1, wherein said hinge of said screen is a living hinge.

16. The exterior vent of claim 1, wherein said screen comprises a plurality of substantially rectangular corrugations having outwardly facing surfaces and secondary surfaces perpendicular to said outwardly facing surfaces, wherein said outwardly facing surfaces are solid and said secondary surfaces have air flow passageways.

17. The exterior vent of claim 1, wherein said top further comprises extended side wall baffles to shelter said air flow outlet from the effects of outside weather.

18. The exterior vent of claim 1, wherein said top further comprises an extended front wall baffle to shelter said air flow outlet from the effects of outside weather.

19. The exterior vent of claim 1, wherein said flapper valve is releasably hingedly attached to said one of said upstanding side and end walls.

20. The exterior vent of claim 19, wherein one of a) said upstanding side and end walls, and b) said flapper valve comprises at least one hinge clip and the other of a) said upstanding side and end walls, and b) said flapper valve comprises a hinge post sized and shaped to be press fit into said at least one hinge clip.

21. The exterior vent of claim 1, wherein said base further comprises a collar connector extending below said attachment flange adapted to pass through said sloped surface opening when said vent is installed on an outside of said building envelope, said collar connector having at least two steps with different diameters to permit said collar connector to connect to at least two different sizes of ducts.

22. The exterior vent of claim 21, wherein said collar connector has three steps with three different diameters to permit said collar connector to connect to 4, 5, and 6 inch diameter ducts.

23. The exterior vent of claim 22, wherein each of said steps comprises a knife guide to help removal of unwanted steps.

24. The exterior vent of claim 1, wherein said screen comprises an extended front wall baffle extending from said screen adjacent to said hinge, to shelter said airflow outlet from the effects of outside weather when said screen is hinged into said position between said top and said base.

25. The exterior vent of claim 3, wherein said walls of said top and said side and end walls of said base are substantially flush across said overlapping joint.

* * * * *